United States Patent [19]

Locatelli

[11] 4,241,831

[45] Dec. 30, 1980

[54] HANDLE PARTICULARLY FOR WIRE BASKETS

[76] Inventor: Gianbattista Locatelli, Via Trieste, 12, Lecco (Province of Como), Italy

[21] Appl. No.: 910,791

[22] Filed: May 30, 1978

[30] Foreign Application Priority Data

Jun. 3, 1977 [IT] Italy ..... 24360 A/77

[51] Int. Cl.[3] ..... B65D 21/06; B65D 25/28

[52] U.S. Cl. ..... 206/506; 16/110 R; 16/114 R; 206/513; 220/19; 220/94 R

[58] Field of Search ..... 206/506, 513; 220/94 R, 220/19; 16/114 R, 112, 110 R, 110.5; 224/45 W, 48 W

[56] References Cited

U.S. PATENT DOCUMENTS

| | | | |
|---|---|---|---|
| 1,219,969 | 3/1917 | Lowe | 206/506 X |
| 2,212,065 | 8/1940 | Fischer | 16/114 R |
| 2,287,531 | 6/1942 | Ong | 220/19 X |
| 2,401,063 | 5/1946 | Fordon | 206/506 |
| 2,635,779 | 4/1953 | Pfeiffer | 220/19 X |
| 2,812,875 | 11/1957 | Buzicky et al. | 220/19 X |
| 3,375,953 | 4/1968 | Miller, Jr. | 206/506 |

FOREIGN PATENT DOCUMENTS

| | | | |
|---|---|---|---|
| 945102 | 12/1963 | United Kingdom | 206/506 |

*Primary Examiner*—Allan N. Shoap
*Attorney, Agent, or Firm*—Guido Modiano; Albert Josif

[57] ABSTRACT

A handle for wire baskets comprises an L-shaped body defining first and second legs. A slot adapted for engagement with the upper horizontal cross-bar of the basket is formed through the first leg of the L-shaped body and this latter is movable from a first position wherein the free end of the second leg abuts against the lower horizontal cross-bar of the basket and the first leg extends outwards for hanging the basket, to a second position, wherein the second leg extends inwards of the basket and the first is laid along the wall thereof.

3 Claims, 5 Drawing Figures

HANDLE PARTICULARLY FOR WIRE BASKETS

BACKGROUND OF THE INVENTION

This invention relates to a handle structure for containers in general and, in particular, for freezer baskets and the like.

In freezers and the like, baskets are currently utilized which are made of iron rod or wire, bent and entwined and welded at the intersection points, whereto handles are attached at two opposed ends thereof, which handles are required to be designed such as to have several operational positions. More specifically, the handles are required to function as a holder for the basket i.e. the handles must have at least one of their portions estended outwardly such as to allow for the basket to be rested, for example, on the edges of a freezer. The handles, moreover, must be provided with another position capability wherein they define, within the basket substantially at the upper edge thereof, a bracket member adapted for supporting an overlaid basket.

Furthermore, the handles are also required to have a position wherein they have, either above or within the basket, approximately at the upper edges of handle attachment, an element effective to allow the basket to be lifted out when located inside the freezer, the walls whereof, on account of the first operational position mentioned above, nearly adhere to those of the basket whereto the handles are secured; thus, the latter must have in that position a much reduced projecting dimension outwardly from the basket.

Moreover, the handles have to be also positionable such as to allow each basket to be stacked within the next, in order to afford a decreased bulk for transporting and storing.

To provide a solution for the aforesaid problems, handles have been proposed which have a substantially L-like shape. and, at a middle portion of the longer leg of the "L", are hinged to the upper horizontal cross-bar, which is normally provided at the upper edge of such a basket. The baskets also include generally a lower cross-bar which extends parallel to said upper cross-bar. Attachment of the cited handle type requires the provision of a window in the wall of the basket underlying the lower cross-bar and occupying the full width of the handle.

With this type of handle, it becomes possible to pivot the handle such that the shorter leg of the "L" extends upwardly to the outside for placing the basket in a suspended position, whilst in this position the longer leg of the "L" practically leans against to the basket wall, allowing several baskets to be stacked for transportation.

In addition thereto, the handle just described is pivotable such that the shorter leg of the "L", owing to rotation of the handle through 180° about the upper cross-bar, is caused to face, below the lower cross-bar, the basket inside by moving through said window. In this position, the shorter leg of the "L" acts as a bracket for supporting a basket stacked thereupon.

However, this approach has a basic fault, in that in the position where several baskets are stacked one upon the other, it happens that the overlying basket, resting on the short leg that acts as a bracket therefore, tends to outwardly pivot the short leg, which is held in place because it adheres to the freezer wall. Being the freezer walls generally made of fairly fragile materials, the outward push applied on the short leg of the handle can lead to a deformation of the walls, and in the most serious cases, to a perforation of the wall coatings.

In order to eliminate the cited drawbacks, a further handle design has been proposed which still has an L-like configuration, but instead of being merely hinged about the upper cross-bar and for engaging the handle with said upper cross-bar, has a slot which also allows, in addition to a rotation of the handle about the upper cross-bar, a relative sliding movement between the handle and upper cross-bar.

This handle design also provides a tooth located on the longer leg of the "L" close to the area wherefrom the shorter leg extends which is adapted for insertion astride of the upper cross-bar to prevent, on superimposition of a container, the shorter leg from pivoting outwards and stressing, as mentioned above, the side walls of the freezer.

This solution, while definitely superior to the former, still has the disadvantage of requiring the use of a basket formed with a window.

The formation of the window in the basket causes a considerable increase of the basket cost. In fact, to provide such a window, it is necessary to cut off some of the bars constituting the side wall of the basket, or alternatively to insert bars purposely made shorter and provide, in either cases, an auxiliary cross-bar below the lower cross-bar, such as to allow for the anchoring of the free ends of the cut off bars.

In conclusion, the proposed solution, while significantly good from a functional viewpoint, has the disadvantage of requiring baskets which have to undergo complementary work, which unavoidably negatively affects the costs thereof.

SUMMARY OF THE INVENTION

Thus, it is an object of this invention to provide a handle structure having highly functional characteristics, while requiring no adaptation of the baskets wherefor it is intended, that is a handle that can be applied to a basket without the latter having to be provided with the cited window.

It is another object of the invention to provide a handle structure which, while having improved characteristics, is extremely simple to manufacture and in no way inferior to the prior art handles.

A further object of this invention is to provide a handle structure which affords considerable economical advantages, especially in relation to the manufacturing of the baskets whereto it is to be attached, which advantages become even more significant in view of the high number of baskets which are currently manufactured.

According to the invention, these and other objects, such as will be apparent hereinafter, are achieved by a handle structure for containers in general, and freezer baskets in particular, characterized in that it comprises a body of substantially L-like shape, first and second legs, defined by said L-shaped body, a slot adapted for engagement with the upper horizontal cross-bar of a container or the like provided on said first leg, said body being movable from a first position, wherein the free end of said second leg abuts against the lower horizontal cross-bar of said container, and said first leg extends outwards for hanging said container, to a second position, wherein said second leg extends inwards of said container at said upper horizontal cross-bar, and said first leg is laid along the wall of said container, externally thereto, and/or viceversa.

BRIEF DESCRIPTION OF THE DRAWING

Further features and advantages will become apparent from the following description of a preferred embodiment, though not a restrictive one, of a handle structure for containers in general, and freezer baskets in particular, illustrated by way of example and not of limitation in the accompanying drawings, where.

DESCRIPTION OF THE PREFERRED EMBODIMENTS

Figure 2:
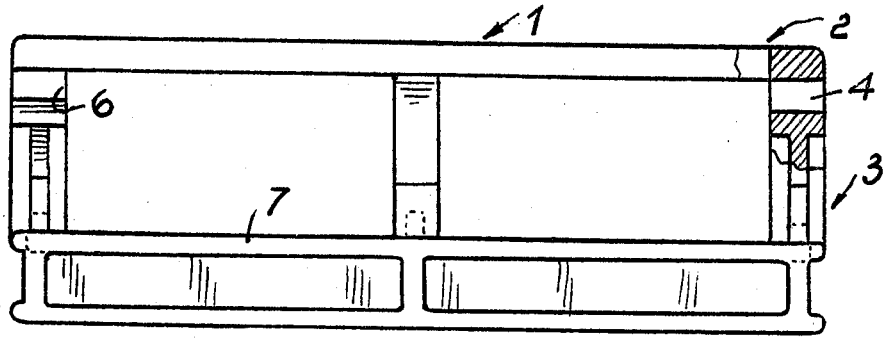
FIG. 2 is a front view, partly cut away, of the handle shown in FIG. 1.

With reference to the cited drawing figures, the handle structure according to the invention comprises a body 1 of substantially L-like configuration and defining a first leg 2 and second leg 3, perpendicular to each other and a corner portion 1*a* connecting the first leg 2 with the second leg 3.

The body 1, which is of preference of a plastics material with wide inner windows, includes on the first leg 2, and more precisely on the side ends of the leg 2, a slot or oblong hole 4 extending longitudinally with respect to the extension of said first leg 2. At the end of the slot 4, on the side of the free end of the first leg 2, there is provided a projection 5 which defines a seat 6 open towards the free end of the leg 2.

The second leg 3 has, at its free end, a rim or projecting edge 7 extending substantially parallel to the free edge of the leg 3.

In said slot 4, the ends of the upper horizontal cross-bar 8 are engaged, said cross-bar being usually provided on the upper edge of a basket generally indicated at 9; on the basket 9, below the upper horizontal cross-bar 8 and spaced apart therefrom, there is provided a lower horizontal cross-bar 10.

Figure 1:
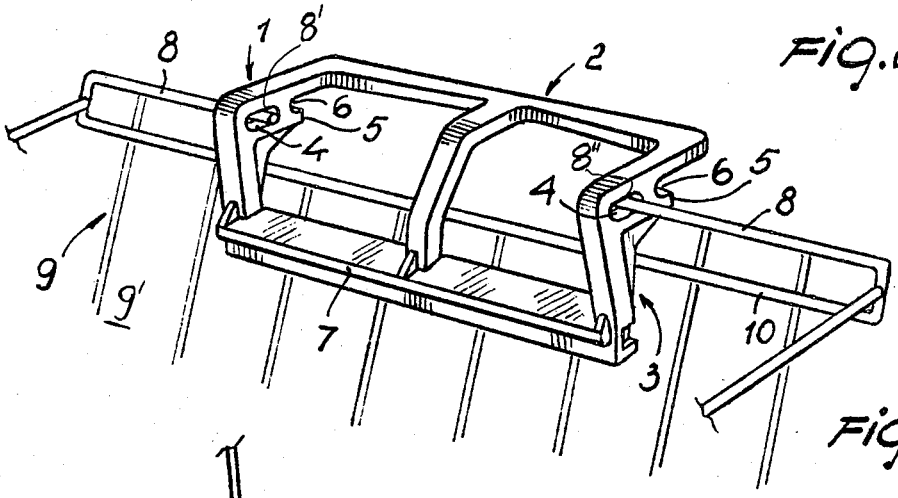
FIG. 1 is a perspective view of the handle according to this invention as attached to a wire basket.

As visible in FIG. 1 the cross-rod 8 is interrupted in a central part thereof so that the end portions or terminals of the cross-rod 8 may be slipped through the slots 4 of the handle, when the handle is mounted.

The described handle is arranged, in its first position (FIGS. 1 and 3) such that the first leg 2 extends towards the outside of the basket or container 9, whereas the middle or corner portion 1*a* of the handle abuts the lower cross-rod 10 with an abutment surface 1*b* of the corner portion 1*a*.

Figure 3:
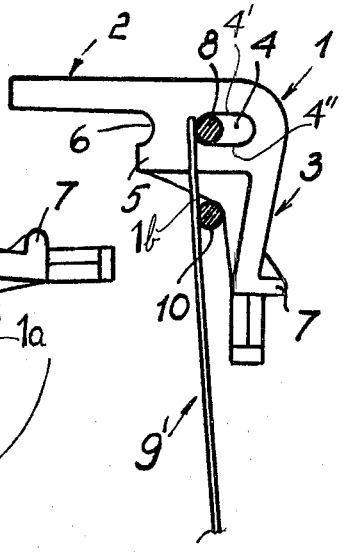

In this position, it thus becomes possible to hold the basket suspended, since the first leg 2 can be made to rest on a supporting member, and the handle is prevented from swinging with respect to the basket by the second leg 3 abutting the lower cross-bar 10 (FIG. 3). It will be appreciated that in this position the leg 2 operates as a basket holder.

In this position, furthermore, it is possible to insert several baskets one within the other for transportation.

Figure 5:
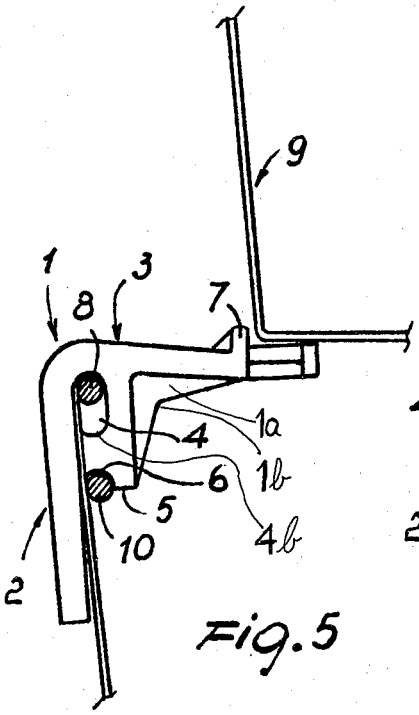
FIGS. 3, 4 and 5 show side views of the inventive handle in its various operational positions, with the bars of the basket shown in cross-section.
Figure 4:
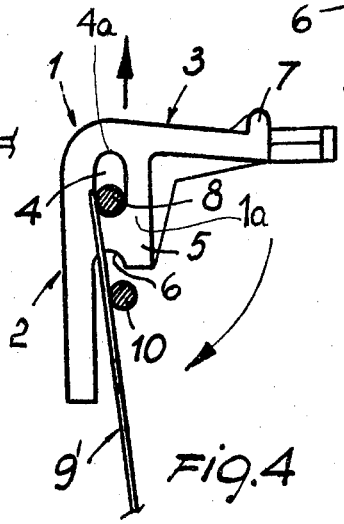

In order to bring the handle to its second position, it is sufficient that the handle be swung around the upper cross-bar to move the second leg 3 to a substantially horizontal position (FIGS. 4 and 5).

During this pivoting movement the upper cross-bar 8 engages with its terminal the bottom of the slot 4, the bottom of the slot defining herein a second seat 4*b* at that end thereof which is located near the free end of the first leg 2. That pivoting movement allows the projection 5 to clear the lower cross-bar 10.

Upon completion of the pivoting movement, the slot 4 is caused to slide with respect to the upper cross-bar 8 until the cross-bar reaches the top or first seat 4*a* of the slot 4 and the lower cross-bar 10 is seated in the third seat 6 defined by the projection 5 (FIG. 5).

In this position, the handle is stable in that it cannot swing any further, and the second leg 3 extends toward the inside of the basket 9 to act as a support or braclet for the basket stacked thereupon, whilst the first leg 2 is arranged externally to the basket in a substantially vertical position; it should be noted here, that the second leg 3 is arranged at the level of the upper cross-bar 8, thus allowing for a complete filling up of the basket 9.

The raised or projecting edge 7 formed at the rim of the second leg 3 serves to form a centering or alignmment seatfor the bottom of the upper basket 9, thus preventing it from moving about.

Thus it may be seen that a handle of this type permits the basket to be withdrawn from a freezer or the like, even when there exists no side clearance outside of the basket.

From the foregoing description the following structural and functional features should be noted.

The wire basket 9 has a first cross-bar 8 in a horizontal plane at the top end of a side wall 9' of the basket 9. The side wall 9' has also a second continuous cross-bar (10) spaced below and parallel to the first cross-bar 8. The top cross-bar 8 includes two opposing free ends 8' and 8'' formed by a discontinuity of the top cross-bar 8 along the side wall 9. The second cross-bar 10 is continuous below the discontinuity of the top cross-bar 8. The handle comprises a first leg 2 unitarily connected to a second leg 3 forming an L-shaped body; a corner member 1a spanning the interior angle formed by the first and second legs 2 and 3; an oblong hole 4, through said corner member 1a having two opposing arcuate end surfaces 4*a* and 4*b* interconnected by two opposing side surfaces 4' and 4''; the major axis of said oblong hole extends in a generally parallel direction to said first leg 2. One 4*a* of said arcutate end surfaces is adjacent said second leg 3. One 4' of said side surfaces 4', 4'' is adjacent said first leg 2. Said one of said arcuate end surfaces defining a first seat 4*a*, the opposing arcuate end surface defining a second seat 4*b*. Said corner member 1*a* has an end surface 6 adjacent the intermediate length of said first leg 2. Said end surface 6 has an outwardly facing arcuate surface aligned with and in the same facing direction as said first seat 4*a* and defining a third seat 6. Said oblong hole 4 is adapted to slidably receive one of said free ends (8' or 8'' of said first cross-bar 8, said third seat 6 is adapted to engage said second cross-bar 10 when said handle 1 is mounted on said basket 9 with said first seat 4*a* engaging said first cross-bar 8 thereby firmly maintaining said handle 1 in a first position on said basket 9, said first leg 2 being substantially parallel to and exterior of said side wall 9 and said second leg 3 being transversely to and extending inwardly from said side wall 9 in said first position (FIG. 5). Said handle in said first position functions as a bracket for supporting the bottom of another basket resting on said second leg 3. Said corner member (1*a*) has a flared abutment surface 1*b* offset from said third seat 6 and said oblong hole 4 in a location closer to said second leg 3 than said first seat 2. Said abutment surface 1*b* is arranged, when said handle 1 is mounted on the basket 9, to abut said second cross-bar 10 in a second position of said handle (FIG. 3)

said first cross-bar 8 is in engagement with said second seat 4b in said second position with said first leg 2 being transversely to and extending outwardly from said wall 9 and with said second leg 3 extending downwardly, interiorly of the side wall 9. When the first leg 2 is in said second position it functions as a holder for the basket 9 to which it is adapted to be mounted. Said handle 1 is rotatable from said first position to said second position and vice versa when mounted to said side wall 9. Said second leg has a raised portion 7 acting as an alignment means for an overlaid basket in the first position of said handle 1.

From the foregoing description, it will be apparent that the invention fully achieves its objects, and in particular the fact is stressed that with the instant handle, it becomes possible to utilize baskets which lack the side windows, such as must be provided in the prior art baskets, which windows, as mentioned above, involve a considerable increase of labor, and accordingly, of the manufacturing costs.

It should be further added that, while in the foregoing description, reference has been made to baskets for use in freezers, the handle structure of the invention is also useful for any convenient type of containers.

The invention is susceptible to many modifications and variations, which all fall within the scope of the instant inventive idea.

Moreover, all details may be replaced by other technically equivalent elements.

I claim:

1. A handle for a wire basket, the wire basket having a first cross-bar in a horizontal plane at the top end of a side wall of the basket and having a second continuous cross-bar spaced below and parallel to the first cross-bar, the top cross-bar including two opposing free ends formed by a discontinuity of the top cross-bar along the side wall, the second cross-bar being continuous below the discontinuity, said handle comprising:

a first leg unitarily connected to a second leg forming an L-shaped body; a corner member spanning the interior angle formed by the first and second legs; an oblong hole through said corner member having two opposing arcuate end surfaces interconnected by two opposing side surfaces, the major axis of said oblong hole extending in a generally parallel direction to said first leg, one of said arcuate end surfaces being adjacent said second leg, one of said side surfaces being adjacent said first leg, said one of said arcuate end surfaces defining a first seat, the opposing arcuate end surface defining a second seat; said corner member having an end surface adjacent the intermediate length of said first leg; said end surface having an outwardly facing arcuate surface aligned with and in the same facing direction as said first seat and defining a third seat;

said oblong hole adapted to slidably receive one of said free ends of said first cross-bar, said third seat adapted to engage said second cross-bar when said handle is mounted on said basket with said first seat engaging said first cross-bar thereby firmly maintaining said handle in a first position on said basket, said first leg being substantially parallel to and exterior of said side wall and said second leg being transversely to and extending inwardly from said side wall in said first position, said handle in said first position functioning as a braket for supporting the bottom of another basket resting on said second leg; said corner member having a flared abutment surface offset from said third seat and said oblong hole in a location closer to said second leg than said first seat, said abutment surface being arranged, when said handle is mounted on the basket, to abut said second cross-bar in a second position of said handle, said first cross-bar being in engagement with said second seat in said second position with said first leg being transversely to and extending outwardly from said wall and with said second leg extending downwardly, interiorly of the side wall, said first leg in said second position functioning as a holder for the basket to which it is adapted to be mounted, said handle rotatable from said first position to said second position and vice versa when mounted to said side wall.

2. A handle structure according to claim 1, wherein said second leg has a raised portion acting as an alignment means for an overlaid basket in the first position of said handle.

3. A handle structure according to claim 1, wherein said handle is, in combination, together with said basket, said handle mounted to said side wall of said basket.

* * * * *